United States Patent [19]

Rothenberger

[11] 4,447,926

[45] May 15, 1984

[54] PIPE CLEANING MACHINE HAVING A CONTAINER TO ACCOMMODATE CLEANING SPIRALS OF VARIOUS DIAMETER

[75] Inventor: Günter Rothenberger, Bad Homburg, Fed. Rep. of Germany

[73] Assignee: Rothenberger GmbH & Co., Frankfurt am Main, Fed. Rep. of Germany

[21] Appl. No.: 356,985

[22] Filed: Mar. 11, 1982

[30] Foreign Application Priority Data

Mar. 14, 1981 [DE] Fed. Rep. of Germany ..... 3119876

[51] Int. Cl.[3] ..... B08B 9/02

[52] U.S. Cl. ..... 15/104.3 SN

[58] Field of Search ..... 15/104.3 SN, 104.3 R; 254/134.3 FT

[56] References Cited

U.S. PATENT DOCUMENTS

| | | | |
|---|---|---|---|
| 2,940,099 | 6/1960 | Kollmann | 15/104.3 SN |
| 3,213,473 | 10/1965 | Singer | 15/104.3 SN |
| 4,291,429 | 9/1981 | Servadio | 15/104.3 SN |

*Primary Examiner*—Edward L. Roberts

*Attorney, Agent, or Firm*—Felfe & Lynch

[57] ABSTRACT

The invention concerns a pipe cleaning machine for rotating cleaning spirals of different diameters. To adapt the container for the cleaning spiral and the machine to cleaning spirals of different diameters with a minimum of accessories, the container for the cleaning spirals is made in a known manner in the form of a guide hose, but the inside diameter of the guide hose and of its coupling to the machine is equal to or greater than the inside diameter of the hollow shaft parts of the machine which receive the cleaning spirals and a collet for adapting the machine and the guide hose to different cleaning spiral diameters is removably mounted in the coupling.

6 Claims, 5 Drawing Figures

Figure 1:
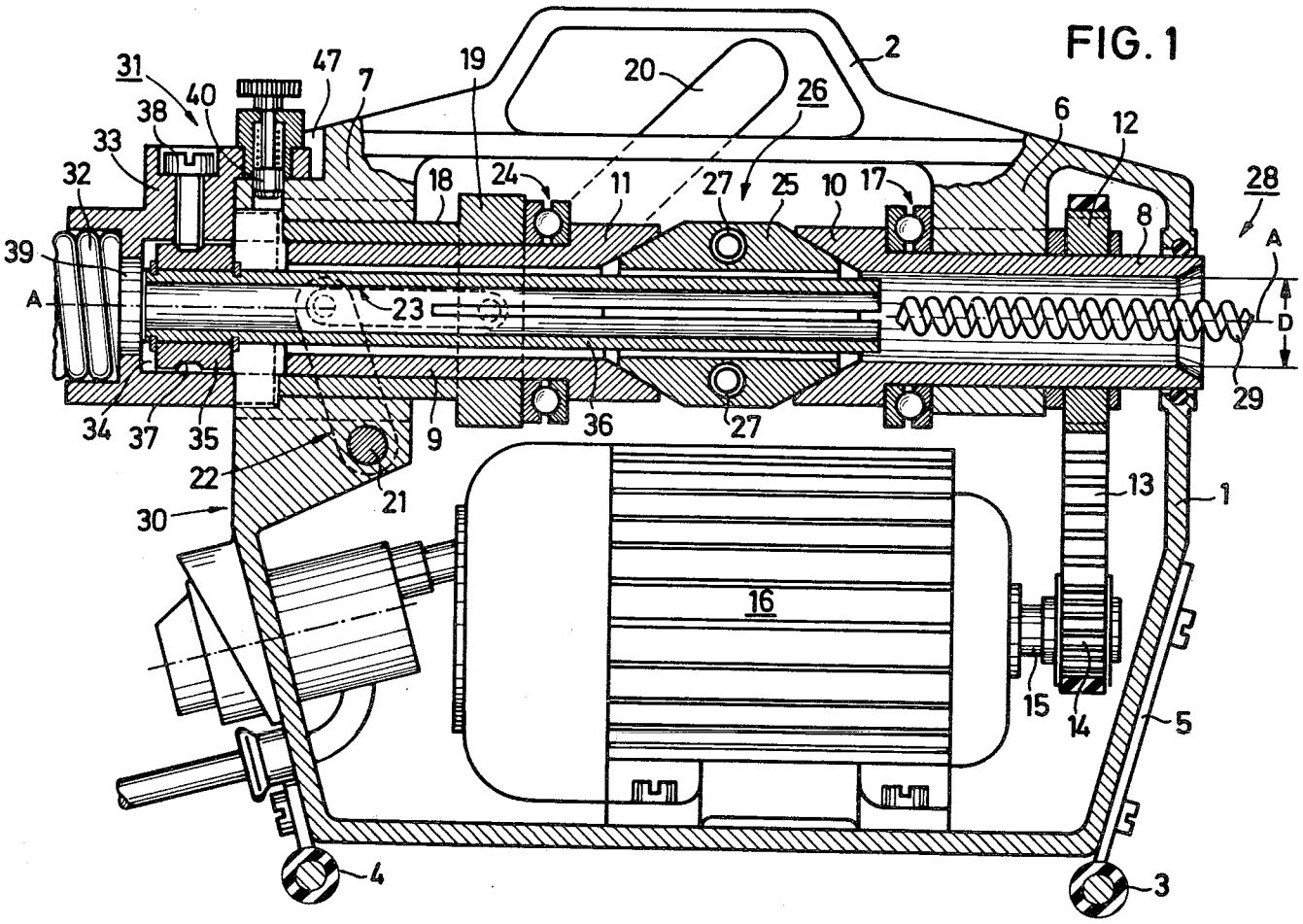

FIG. 3
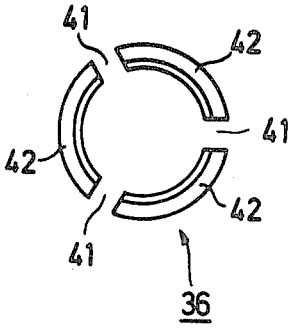
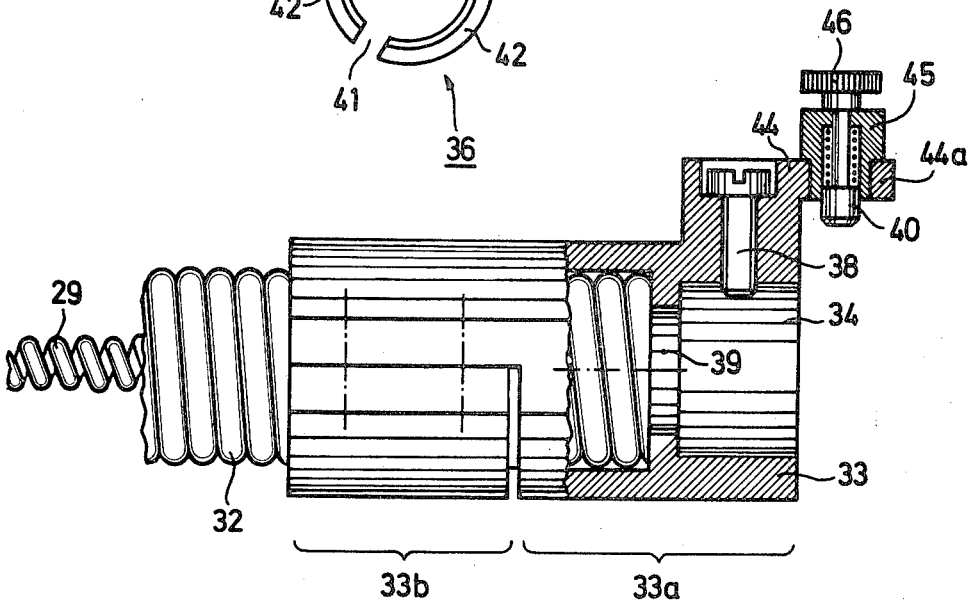
FIG. 4
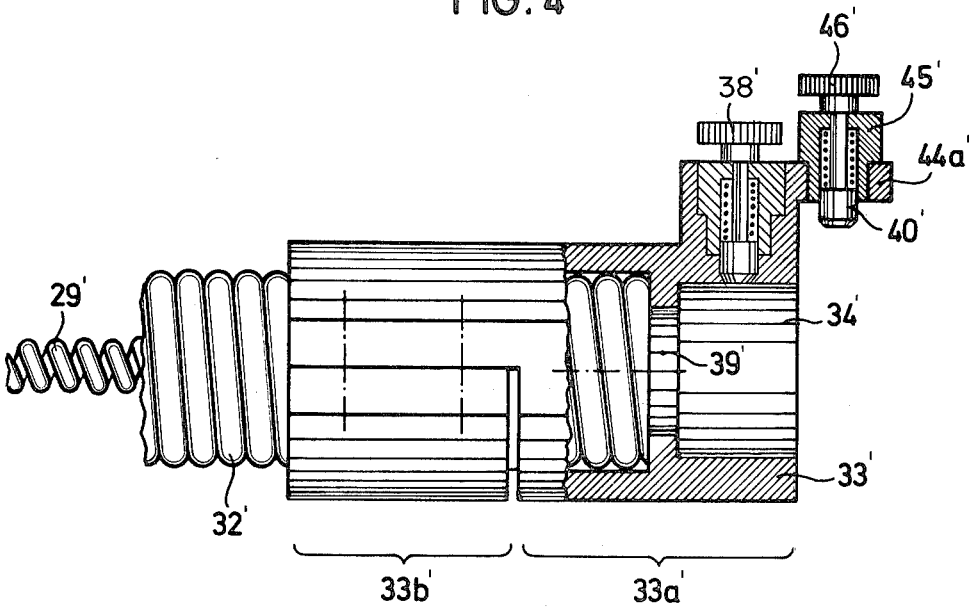
FIG. 6

PIPE CLEANING MACHINE HAVING A CONTAINER TO ACCOMMODATE CLEANING SPIRALS OF VARIOUS DIAMETER

The invention relates to a pipe cleaning machine for driving cleaning spirals of various diameter, having a container serving to accommodate the end of the cleaning spiral that is not in use, the container being able to be attached by means of a coupling to the housing in alignment with a rotary clutch in the housing, and having a rotatable collet which can be introduced into the rotary clutch from without and which spans differences in diameter.

Such pipe cleaning machines serve for cleaning all kinds of sewer pipes and mains which often contain a number of elbows, angles, etc. Often, the point of access to the pipeline is at a considerable distance from the point of stoppage to be cleaned. The cleaning spirals, which are not "true" spirals in the mathematical sense but coil springs in principle, are therefore made in finite lengths which can be extended by special couplings. The pipe cleaning machines for axially advancing and rotating these cleaning spirals are usually made in the form of cases or small carts from the back end of which the back end of the cleaning spiral that is not in use protrudes. Formerly, the back end was allowed to rotate freely on the ground where it often curved longitudinally and began to thrash about. It must be considered in this regard that the rotary speeds amount to as much as 600 rpm to permit the use, for example, of chain flails and cutters on the cleaning end of the cleaning spiral. Accidents have been caused by the thrashing of the back end of the cleaning spiral so that, since then, safety rules have prescribed that the back end of the cleaning spiral be held in a container.

It is known, for example, to use as the container so-called adapter magazines, which are rotatable drums attached to the machine housing for rotation with the rotary clutch. The cleaning spiral is coiled up in a helix within the drum, in layers if its length so requires. This coiling is not always perfect. Occasionally, larger or smaller loops or slanting coils form in the drum so that a considerable imbalance is the result. Since the drum necessarily rotates at the same speed as the cleaning spiral, the entire apparatus then begins to shake.

Furthermore, if the drum is wholly or partially full, a considerable moment of inertia is formed, so that in the common mode of operation of the machine with frequent starts and stops, the drum has to be braked to a stop. Otherwise, the spiral would continue to rotate at the drum speed after the clutch was disengaged until the energy of the rotating mass had dissipated. In the case of a stubborn sewer pipe stoppage, this can result in the destruction of the spiral or of the cleaning tool mounted on the spiral. As a rule, therefore, the known drums are provided with a brake, usually a cone brake, operated by a mechanism present in the machine housing, usually the clutch lever operated in the opposite direction.

The nominal diameters of the cleaning spirals most commonly used today amount to 8, 10, 16 and 22 mm. So many different spiral diameters are needed in order to satisfy the various cleaning requirements, which are mainly determined by the size and the course of the sewer line. On account of the great bulk of cleaning spirals of large diameter wound in drums it is impossible, for practical reasons, to provide a single drum size, for all four nominal diameters, the capacity of which would then, of course, have to correspond to the cleaning spiral having the greatest length and greatest diameter. Therefore the procedure is, as a rule, to use drums of different diameter.

Cleaning spirals with the above-named nominal diameters between 8 and 22 mm can generally not be driven by the same rotary clutch without special provisions, since the known geometry of the clutch jaws does not cover such a range. However, the same rotary clutch can easily be used to drive 16 mm and 22 mm spirals. Likewise, it is possible with a rotary clutch of another size to drive 8 mm and 10 mm spirals.

The determining factor is the inside diameter of a hollow shaft of the clutch, which has to be slightly larger than the outside diameter (nominal diameter) of the largest cleaning spiral that is used. To be able to use a machine designed for 16 mm spirals also for 8 mm and 10 mm spirals, it is known to provide such a machine with two drums which are equipped with so-called collets. The collets are tubes provided with three slits which are fixedly joined to the drum and its brake cone. The outside diameter corresponds to the 16 mm spiral, while the inside diameter corresponds at one end to the 8 mm spiral and at the other to the 10 mm spiral. So, in any case two collets and two drums are needed, but they are still burdened with the problems set forth above. For the 16 mm spiral, the known machine is equipped with a so-called guide hose. This system creates the need for a great deal of accessory equipment which always has to be carried together with the machine.

It is furthermore known to join a collet which can be used simultaneously for 8 mm and 10 mm spirals permanently to a guide hose so that the collet is rotatable with respect to the guide hose, but is not easily detached therefrom. Furthermore, the guide hose only accommodates spirals of a maximum nominal diameter of 10 mm, so that for larger spiral diameters an additional guide hose—without a collet—has to be on hand. The two guide hoses together require an amount of space which considerably exceeds that required by the machine alone.

The invention is therefore based on the problem of creating a pipe cleaning machine of the kind described above, which will have a minimum of accessories as regards the container for receiving the cleaning spirals and as regards the arrangements for adaptation to various cleaning spiral diameters.

The stated problem is solved in accordance with the invention in a pipe cleaning machine as described above by the fact that the container for the cleaning spiral is constructed in a known manner as a guide hose, but that the inside diameter of the guide hose and of its coupling to the machine are equal to or greater than the inside diameter of the hollow shaft arrangement in the machine which receives and rotates the cleaning spiral, and that a collet for adopting a rotary clutch of the hollow-shaft cleaning-spiral rotating arrangement and the guide hose to different cleaning spiral diameters is mounted releasably in the coupling.

By "releasable" in the above connection is meant any kind of mounting or fastening which prevents any unintentional displacement of the collet within the hollow shaft or clutch, but permits replacement of the collet without special tools or even exclusively by the application of force. This can be accomplished, for example, by the fact that the collet is held positively in the coupling by means of a screw that can be drawn tight against the collet bearing. In this case a screwdriver will suffice to permit the collet and its bearing to be removed from the coupling. It is, however, also easily possible to insert the collet bearing into the coupling by means of a snap fastening. Such snap fastenings exist in the form of so-called ball snap fastenings. In this case a steel ball, which is limitedly displaceable under the action of a spring, is urged into a matching recess in the collet bearing. This effectively prevents any undesired entrainment of the collet bearing; the collet, however, can be removed from the coupling together with the bearing by pulling it.

It has already been stated above that the inside diameter of the hollow shaft is the characteristic dimension for a particular pipe cleaning machine. By making both the inside diameter of the guide hose and that of the coupling equal to or greater than the inside diameter of the hollow shaft, it is thus brought about that the guide hose can be used for all cleaning spirals for which the machine is designed. Consequently, the provision of a single guide hose will suffice for any model of machine. Due to the easy releasability of the collet from the coupling, the guide hose can be used either with or without the collet.

It is also especially advantageous if both the clutch and the collet are made so as to be compressible in the unloaded state to at least two different nominal diameters of cleaning spirals on the basis of the spacing of the clutch jaws and of the collet jaws, respectively.

By the combination of these measures, it is brought about, for example, that the same guide hose—without collet—can be used both for 22 mm and for 16 mm cleaning spirals, and that again the same guide hose—with collet—can be used both for 10 mm and for 8 mm spirals. A single pipe cleaning machine in conjunction with a single guide hose can consequently be used for a total of four different spiral diameters if the hollow shaft is dimensioned accordingly, without the need for additional accessories.

Figure 2:
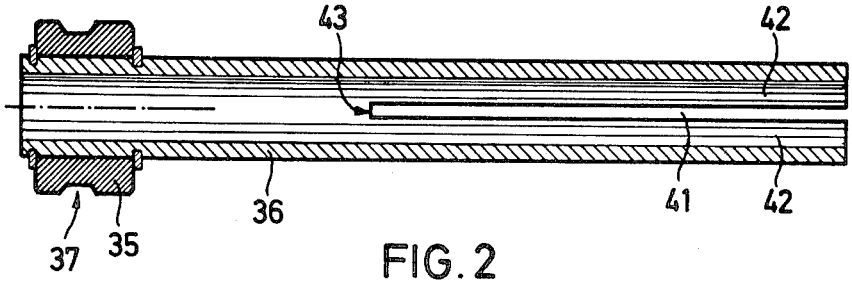
Figure 5:
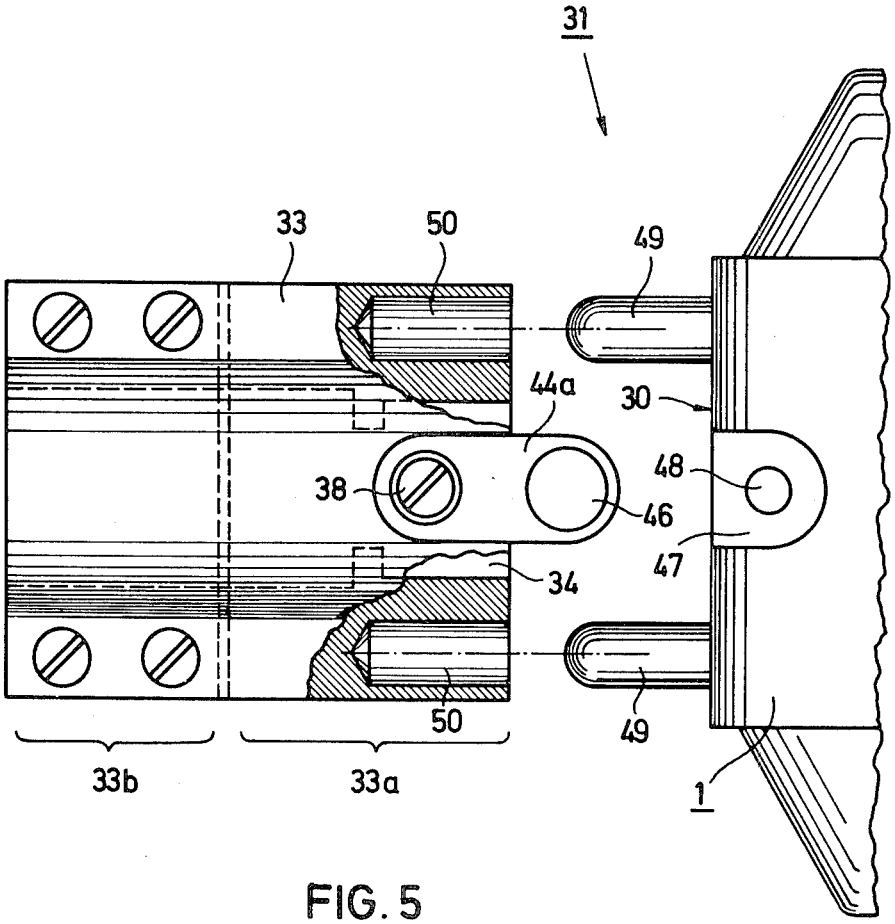

An embodiment of the invention is explained in detail hereinafter with the aid of FIGS. 1 to 5, in which:

FIG. 1 is a partial vertical cross section through a complete pipe cleaning machine, FIG. 2 is a longitudinal cross section through the collet with collet bearing, FIG. 3 is an end view of the slotted end of the collet of FIG. 2, FIG. 4 is a cut-away side view of the part of the coupling that is joined to the guide hose, FIG. 5 is a view of the rear end of the machine with the housing portion of the coupling, and, partially cut away, the part of the coupling that is joined to the guide hose, and FIG. 6 is a cut-away side view of the part of another coupling embodiment that is joined to the guide hose like that of FIG. 4, In FIG. 1 there is shown a housing 1 which envelops all of the working parts of the pipe cleaning machine and is more or less of a suitcase-like shape. For carrying purposes a carrying handle 2 is provided. Two pairs of rubber feet 3 and 4 serve for standing the machine up, the right pair 3 being affixed to a strip 5 having elongated holes, which are not shown, to permit compensation of the tilt of the machine on a sloping surface.

Two bearing blocks 6 and 7 are integral with the housing 1, and in them two hollow shafts 8 and 9 are journaled. Each hollow shaft consists of a hollow cylindrical portion and a taper socket 10 and 11, respectively, the taper sockets confronting one another. The hollow shafts and taper sockets have identical axes of rotation. Hollow shaft 8 bears a cog belt pulley 12 which is joined by a cog belt 13 to a cog belt pulley 14 mounted on the shaft 15 of an electric motor whose sense of rotation is reversible. The taper socket 10 has a shoulder, not identified by number, at which the hollow shaft 8 thrusts against the bearing block 6 through a thrust bearing 17.

The hollow shaft 9 is journaled only indirectly in the bearing block 7, namely through a sliding sleeve 18 having a collar 19 and guided so as to be longitudinally displaceable but not rotatable in the bearing block 7. The longitudinal displacement is performed by means of an operating lever 20, which is disposed laterally on the housing 1 and is fastened to a lever pivot shaft 21. The pivot shaft is joined by two links 22 and 23 represented in broken lines to the collar 19 of the sliding sleeve 18. By pressing downwardly on the operating lever 20 it is thus possible to shift the sliding sleeve 18 to the right. The taper socket 11 likewise has a shoulder not identified by number at which the hollow shaft 9 thrusts against the collar 19 through a thrust bearing 24. Although, with the exception of the thrust bearings 17 and 24, all the other bearings are shown as friction bearings, it is to be understood that the bearings in question can be rolling bearings and are preferably in the form of needle bearings.

Between the taper sockets 10 and 11 there are three clutch jaws 25 extending into them and distributed about their circumference, and forming together with the taper sockets 10 and 11 a rotary clutch 26. The clutch jaws 25 have at their two ends conical surfaces which are substantially complementary to the tapered surfaces of the taper sockets 10 and 11. The clutch jaws 25 were made by dividing an initial solid of revolution, as represented by the cross-hatching, into three sectors of equal size by axis-parallel radial cuts. The width of the cut was selected such that the clutch jaws afterward can be moved inwardly to such a degree that all of the cleaning spirals and collets can be gripped for which the machine is designed. The clutch jaws 25 are held apart in the unstressed state by means of tangential compression springs 27 which are held in corresponding blind holes in the clutch jaws.

When the machine is in operation and lever 20 is not operated, the clutch jaws 25 are driven by the driven hollow shaft 8 and in turn also drive the hollow shaft 9, so that no slippage occurs between the taper sockets and the clutch jaws. By a downward movement of the lever 20, the taper socket 11 is shifted to the right, causing the clutch jaws 25 to yield radially inwardly on account of the tapered surfaces. As soon as they engage a corresponding solid of rotation, be it a cleaning spiral or a collet, these parts will be driven when a correspondingly intensified pressure is applied to the lever 20.

The front end of the housing is marked 28. From this end there emerges that part of a cleaning spiral 29 which is used for the cleaning process. The front end 28 is thus facing the opening through which the cleaning spiral 29 is introduced into the pipe line that is to be cleaned. At the rear end 30, the housing has a coupling 31, parts of which pertain to the housing 1, and parts to a guide hose 32 which is a kind of container for the end of the cleaning spiral 29 which is not in use. The part of the coupling 31 that pertains to the guide hose is to be called the plug 33, although it is to be understood that the coupling can be made not only by an action of plugging in, but also by an action of screwing, or a combined type of coupling can be used, such as a bayonet coupling for example. Details of the coupling 31, however, will be explained further below in conjunction with FIGS. 4 and 5. Here let it be said only that in the plug 33 there is a cylindrical recess 34 whose axis coincides with the common axis A—A of the entire system. In the recess 34 there is a collet bearing 35 in which a collet 36 is rotatably mounted. The axial fixation of the collet in the bearing is accomplished by means of retaining rings not identifed by number. In the collet bearing 35 there is an annular groove 37 which is engaged radially by a set screw 38 whose complementary thread is in the plug 33. In this manner the collet bearing 35 and thus the collet 36 is reliably held fast in the plug 33. Especially the collet 36 is coaxially aligned with the common axis A—A of the system. While details of the collet will be further explained in connection with FIGS. 2 and 3, FIG. 1 shows the position of the collet relative to the clutch 26.

If in the arrangement represented in FIG. 1 the clutch 26 is operated in the manner described above, the clutch jaws 25 first come in contact with the collet and drive it circumferentially—with slippage at first. The collet begins to rotate in the collet bearing 35. The portion of the cleaning spiral 29 that is within the collet has been omitted for the sake of clarity. As the clutch 26 continues to be operated, the collet 36, too, is compressed radially, applying itself to the cleaning spiral 29, setting it in rotation. It can be seen that, when the collet has been removed simply by loosening a screw 38, shown in FIG. 4 or a snap fastener 38', like index pin 40, shown in FIG. 6 (when the coupling 31 has been removed from the machine simply by lifting pin 40 as described below), instead of the small cleaning spiral 29 that is shown, it is possible to introduce into the system even a spiral that reaches the cylindrical surfaces of the hollow shafts. It has already been stated above that the characteristic feature is the inside diameter of the hollow shaft or hollow shafts 8 and 9, which is given in FIG. 1 as "D". After the collet 36 has been removed any cleaning spiral whose outside diameter is sufficiently smaller than the dimension "D" can be inserted into the system. It can be understood that the inside diameter of the guide hose 32 satisfies the conditions of the invention, and that also a bore 39 in the plug 33, which defines a shoulder for the abutment of the guide hose 32, satisfies the conditions of the invention.

To fix the plug 33 with respect to the housing 1, an index pin 40 is also disposed on the plug 33 and engages a corresponding housing bore (FIGS. 4 and 5). While it is possible for the plug 33 to be fastened so as to be held against rotation, especially by the means shown in FIG. 5, it is possible to provide the plug of FIG. 1 with a hollow cylindrical projection, represented in broken lines, which is engaged in a corresponding recess in the housing 1.

It is apparent from FIGS. 2 and 3 that the collet 36 is made of a tube (seamless drawn precision steel tube) whose end facing away from the collet bearing 35 is slitted in the axial direction for a considerable length, three slits 41 being distributed equidistantly about the circumference. Thus three fingers 42 are formed, which can be moved radially inwardly under the action of the clutch 26. The deformation that is thus produced is merely a resilient deformation on the basis of sufficient elastic properties of the material. The end 43 of slit 41 is, as shown in FIG. 1, situated at a point which is markedly beyond the clutch jaws 25, so that no blocking of the clutch can occur. The width of the slit 41 is made such that a sufficiently great inward movement of the fingers 42 is permitted to allow cleaning spirals 29 of different nominal diameters to be driven.

It can be understood from FIGS. 4 and 5 that the plug 33 consists of a closed portion **33*a* and a longitudinally divided portion 33*b*. The longitudinally divided portion 33*b* forms a kind of clamp for gripping the guide hose 32. On the closed portion 33*a* there is a projection 44 in the direction of the housing 1 (FIG. 1), which projects radially and axially in relation to the plug. The index pin 40 is mounted in the axial projection 44*a*, namely in a casing 45 which encloses also a compression spring not indicated by number. The index pin 40 can be raised upward by means of a knurled knob 46. After lifting the index pin 40 it is possible to connect the plug 33 to the housing 1** or to remove it therefrom.

It can furthermore be seen in FIG. 5 that, at the rearward end of the housing 1, just above the axis A—A, there is a housing recess 47 which corresponds to the dimensions and the position of the axial projection **44*a*. In the center of the recess 47 there is a bore 48 which serves to engage the index pin 40. At diametrically opposite points in the rear opening of the housing 1, through which the cleaning spirals and/or the collets are introduced, there are two rounded pins 49 which serve for the guidance and holding of the plug 33. For this purpose there are two substantially complementary bores 50 in the plug 33, with which the plug 33 can be pushed onto the pins 49**.

I claim:

1. In a pipe cleaning machine for rotating cleaning spirals of various outside diameters, the machine having a guide-hose container having a passage therethrough for passing the cleaning spiral, a coupling for releasably coupling the guide-hose container to the machine having a passage therethrough for passing the cleaning spiral, at least one hollow-shaft portion having a passage therethrough for passing the cleaning spiral from the coupling through the machine to a free end of the cleaning spiral for cleaning use, a rotationally-driven rotary clutch having jaws defining a passage therethrough aligned with the hollow-shaft portion and movable radially into the passage for passing the cleaning spiral, and means for moving the rotary clutch jaws radially into the passage therethrough, whereby to rotationally drive the cleaning spiral therein, the improvement comprising:

means in the guide-hose container, coupling, hollow-shaft portion, and rotary clutch for defining the inside diameter of the passages therethrough to be at least as large as the largest outside diameter of the cleaning spirals to be used with the machine, whereby at least the guide-hose container does not have to be changed with the cleaning spirals of various outside diameters; and means in the coupling for releasably mounting a rotatable collet therein, whereby the collet adapts the hollow-shaft portion and rotary-clutch jaws for cooperation with at least one of the cleaning spirals smaller than the one of largest outside diameter and is the only accessory needed therefor.

2. The pipe cleaning machine of claim 1, and further comprising the collet, the collet comprising a tube having an inside diameter for receiving at least one of the cleaning spirals having an outside diameter smaller than the largest, a bearing on one end for allowing the tube to rotate in the means for releasable mounting the collet in the coupling, and means on the opposite end cooperative with the rotary-clutch jaws for radial displacement into the passage in the rotary-clutch jaws, whereby to pressingly and rotationally engage the cleaning coil therein.

3. The pipe cleaning machine of claim 2, wherein the means in the coupling for releasably mounting the collet in the coupling comprises a screw radially advancable into the passage in the coupling.

4. The pipe cleaning machine of claim 2, wherein the means in the coupling for releasably mounting the collet in the coupling comprises snap fastening means on one of the coupling and collet and cooperative with the other.

5. The pipe cleaning machine of claim 1, wherein the means in the coupling for releasably mounting the collet in the coupling comprises a screw radially advancable into the passage in the coupling.

6. The pipe cleaning machine of claim 1, wherein the means in the coupling for releasably mounting the collet in the coupling comprises snap fastening means on one of the coupling and collet and cooperative with the other.

* * * * *